US006895723B2

(12) United States Patent
Knokey et al.

(10) Patent No.: US 6,895,723 B2
(45) Date of Patent: May 24, 2005

(54) COMPRESSED WOOD WASTE STRUCTURAL I-BEAM

(75) Inventors: Eugene R. Knokey, Anacordes, WA (US); Ernest W. Schmidt, Sheridan, WY (US)

(73) Assignees: The Coe Manufacturing Company, Inc., Portland, OR (US); Wyoming Sawmills, Inc., Sheridan, WY (US)

( * ) Notice: Subject to any disclaimer, the term of this patent is extended or adjusted under 35 U.S.C. 154(b) by 0 days.

(21) Appl. No.: 10/232,207

(22) Filed: Aug. 29, 2002

(65) Prior Publication Data

US 2004/0040253 A1 Mar. 4, 2004

(51) Int. Cl.[7] ..... E04C 3/12; B27D 1/00

(52) U.S. Cl. ..... 52/729.4; 52/730.7; 52/376; 428/106; 144/347; 144/363; 156/254

(58) Field of Search ..... 52/729.4, 730.7, 52/737.3, 733.2, 376, 636; 144/344–348, 350, 352, 363, 371, 380; 156/62.6, 276, 295, 254, 244.27; 428/106–108, 114, 215, 326, 528–529

(56) References Cited

U.S. PATENT DOCUMENTS

| | | | | | |
|---|---|---|---|---|---|
| 1,377,891 | A | * | 5/1921 | Knight | 52/730.7 |
| 3,813,842 | A | | 6/1974 | Troutner | |
| 3,956,555 | A | | 5/1976 | McKean | |
| 4,061,819 | A | | 12/1977 | Barnes | |
| 4,084,996 | A | * | 4/1978 | Wheeler | 156/257 |
| 4,122,236 | A | | 10/1978 | Holman | |
| 4,191,000 | A | * | 3/1980 | Henderson | 52/729.4 |
| 4,232,067 | A | | 11/1980 | Coleman | |
| 4,255,477 | A | * | 3/1981 | Holman | 428/106 |
| RE30,636 | E | | 6/1981 | Barnes | |
| 4,428,792 | A | * | 1/1984 | Kurita et al. | 156/196 |
| 4,610,913 | A | | 9/1986 | Barnes | |
| 4,681,146 | A | | 7/1987 | Liska et al. | |
| 4,751,131 | A | | 6/1988 | Barnes | |
| 4,967,534 | A | * | 11/1990 | Lines | 52/729.4 |
| 5,022,210 | A | * | 6/1991 | Scott | 52/733.2 |
| 5,022,211 | A | * | 6/1991 | Scott | 52/733.2 |
| 5,040,582 | A | | 8/1991 | Hsu | |
| 5,054,603 | A | | 10/1991 | Churchland et al. | |
| 5,067,536 | A | | 11/1991 | Liska et al. | |
| 5,069,977 | A | | 12/1991 | Goenner | |
| 5,096,765 | A | | 3/1992 | Barnes | |
| 5,135,597 | A | * | 8/1992 | Barker | 156/264 |
| RE34,283 | E | | 6/1993 | Barnes | |
| 5,234,747 | A | | 8/1993 | Walser et al. | |
| 5,352,317 | A | | 10/1994 | Traben et al. | |
| 5,500,070 | A | | 3/1996 | Traben et al. | |
| 5,505,238 | A | * | 4/1996 | Fujii et al. | 144/4.2 |
| 5,652,065 | A | | 7/1997 | Park et al. | |
| 5,755,917 | A | | 5/1998 | Barnes | |
| 5,814,170 | A | | 9/1998 | Shibusawa et al. | |
| 5,881,786 | A | | 3/1999 | Wilderman et al. | |
| 5,934,348 | A | | 8/1999 | Dietz | |
| 6,012,262 | A | | 1/2000 | Irving | |
| 6,056,841 | A | | 5/2000 | Knokey | |
| 6,162,312 | A | | 12/2000 | Abney | |

FOREIGN PATENT DOCUMENTS

| | | |
|---|---|---|
| AU | 136844 | 5/1947 |

OTHER PUBLICATIONS

National Science Foundation, "Project Summary—Wyoming Sawmills, Inc.—Engineered Lumber From Sawmill Residue," (one page), Jun. 9, 1998.

(Continued)

*Primary Examiner*—Winnie Yip
(74) *Attorney, Agent, or Firm*—Chernoff, Vilhauer, McClung & Stenzel, LLP

(57) ABSTRACT

Methods for forming structural beams and the beams resulting from such methods are disclosed. The disclosed methods compress and adhesively bond wood strands into beams. A beam formed from any one of the disclosed methods may, if desired, have any one of several disclosed shapes, strand configurations, or strand densities.

38 Claims, 4 Drawing Sheets

OTHER PUBLICATIONS

National Science Foundation, "Project Summary—Wyoming Sawmills, Inc.—Engineered Lumber From Sawmill Residue," (one page), Jan. 12, 2000.

Geimer et al., "Product and Process Variables Associated With a Shaped Particle Beam," 29$^{th}$ Annual Meeting of Forest Products Research Society (pp. 72–80), Jun. 18, 1975.

"Be the Lowest Cost LVL Producer," *Panelworld*(p. 4), May, 2001.

Jarck et al., "Scrimber Lumber Surfaces Again in U.S. as Timtek," *Panelworld*(pp. 18–24), Jan., 2001.

Irland, Lloyd, "Dynamic Market Trends for Engineered Lumber Products," *Panelworld*(pp. 41–72), Nov., 2001.

"Continued Demand for Glulam, I–Beams, LVL," *Timber Processing*(p. 6), Sep., 2001.

Georgia–Pacific, "Engineered Lumber Products," (pp. 1–3), Nov. 26, 2001.

Wolcott et al., "Fundamentals of Flakeboard Manufacture: Viscoelastic Behavior of the Wood Component," *Wood and Fiber Science*, (pp. 345–361), Oct., 1990.

Salmen, Lennart, "Viscoelastic Properties of In Situ Lignim Under Water–Saturated Conditions," *Journal of Material Science 19*, (pp. 3090–3096), 1984.

Kelley et al., "Relaxation Behaviour of the Amorphous Components of Wood," *Journal of Material Science 22*, (pp. 617–624), 1987.

"Wood as an Engineering Material," *Forest Products Lab 99 Wood Handbook*, (pp. 2–3 and 2–4), 1999.

VTIP, Inc., "VTIP Disclosure No.: 01–004—Viscoelastic Thermal Compression of Wood," (one page), Jul. 10, 2002.

Virginia Tech, "Pressure Improves Wood," (pp. 1–2), Jul. 10, 2002.

Lenth, Christopher, "Wood Material Behavior in Severe Environments," Dissertation Submitted to the Faculty of The Virginia Polytechnic Institute and State University (pp. i–120), May, 1999.

* cited by examiner

COMPRESSED WOOD WASTE STRUCTURAL I-BEAM

The U.S. Government has a paid-up license in this invention and the right in limited circumstances to require the patent owner to license others on reasonable terms, as provided by the terms of Grant No. DMI-0078473 awarded by the National Science Foundation.

BACKGROUND OF THE INVENTION

The present invention relates to methods for forming commercially valuable structural wood beams from wood waste, and to the beams resulting from such methods.

A variety of existing processes are used to form commercially valuable wood products, including dimension lumber such as 2×4s, 2×6s, 4×4s, etc. and other beams. The most common of these methods is simply to saw lumber from round logs of varying diameters. Though this method is both simple and inexpensive, it will typically produce a great deal of milled wood waste. Because commercial dimension lumber is usually of rectangular cross-sectional dimensions, only the central portion of a round log may be used. Thus, as depicted in FIG. 1A, sawing a log 10 into lumber boards 12 will result in milled wood waste comprising slabs 14, edgings 16, and end trimmings 17 (FIG. 2), the latter resulting from sawing the boards to standard lengths. Further, some round wood simply has an insufficient diameter to saw into any commercial dimension lumber or other types of beams.

Another method used to form commercially valuable wood products rotates a round log in a veneer lathe about its longitudinal axis as a large knife peels thin layers of veneer from its circumference. These layers may then be bonded together to form plywood panels or laminated veneer lumber, for instance. Though this method can produce panels and beams much wider than the diameter of most logs, it also produces wood waste called peeler cores, i.e., the cylindrical portion 18 in FIG. 1B remaining after the log has been peeled to the diametric core limit of the veneer lathe. In addition, some portions of the peeled layers may be unusable for plywood or laminated veneer lumber, and thus constitute veneer waste.

Historically, the foregoing large amount of wood waste has been converted to low-end, less valuable wood products such as pulp chips for paper.

Still another method of forming commercially valuable wood products bonds and compresses wood strands or other particles within a press or mold to fabricate structural wood beams. The wood strands or other particles are mixed with an adhesive before being compressed at high pressure. This method may be used to form either a panel that is later sawed into commercially dimensioned composite beams such as 2×4s, 2×6s, 4×4s, etc., or molded composite beams of contoured cross-sections such as I-beams. Unfortunately, this process is expensive in relation to other methods of forming structural beams. Some of this expense derives from the fact that existing methods of forming composite beams require that the strands or other particles used have uniform, very small cross-sectional dimensions to minimize voids in the resulting product, which tend to weaken it. Thus these existing methods require that the strands be sliced or otherwise divided a number of times before being bonded and compressed into the product, which is time-consuming. Another expensive aspect of this process is the large amount of adhesive needed to bond the strands or other particles of small cross-sectional dimensions to one another.

Historically, the foregoing expense has been further aggravated by the fact that the strands or other particles used in this process have been formed from logs that would otherwise be suitable for forming commercial dimension lumber or veneer from traditional milling processes. Though some had thought that wood waste generated from traditional milling processes might also provide an economical source of wood strands, it has proven too difficult to efficiently form usable strands from such wood waste. One major impediment to the use of wood waste in strand fabrication has been the small cross-sectional strand dimensions needed. Not only is it more difficult to control individual wood waste pieces to insure small-dimensional subdivisions of the pieces, but the comparatively small volume of strand produced for each wood waste piece makes strand fabrication a time-consuming task, particularly since each strand must be repeatedly subdivided before it is suitable for use.

For example, Shibusawa, et al., U.S. Pat. No. 5,814,170, suggests that a structural wood product could be fabricated from strands taken from small-diameter logs by first cutting a log into slender boards and repeatedly subdividing those boards into finely split strands of sufficiently small cross-section. This method is slow and expensive, and does not provide a practical method of forming strands from other forms of wood waste, and particularly the more commonly encountered milled wood waste such as edgings, slabs, and end trimmings. In the same vein, Dietz, U.S. Pat. No. 5,934,348 discusses a method of forming wood strands from logs by placing a number of such logs in a bin and feeding them into a rotating blade. Once again, this particular method requires that the strands produced be of small cross-sectional dimensions, necessitating subdivision of the strands, and is not applicable to most types of wood waste.

Dietz also discloses that strands may first be divided from those residual portions of a saw log not within the usable inner region that would ordinarily become milled wood waste during the milling process. In this disclosed process, the boundaries of the usable inner portion of a saw log are first identified. Then the saw log is directed through a parallel array of knives that each slice into the log to a point on the boundary of the usable region. The saw log is then directed through a lathe, producing strands that may then be subdivided to form usable strands. This method, however, necessitates expensive and complex special sawmill equipment, time-consuming multiple subdivisions of the wood waste, and individual strands of small cross-section.

What is desired, therefore, is a cost efficient process for manufacturing structural wood beams from wood waste and a cost-efficient, strong structural wood beam formed from such wood waste.

DETAILED DESCRIPTION

As used in the description and claims hereof, the following terms shall have the following meanings:

1. "Wood waste" means solid wood material, other than sawdust, generally unsuitable for producing solid commercial dimension lumber or conventional laminated veneer products.
2. "Milled wood waste" means a type of wood waste comprising any one of the following types: edgings; slabs; end trimmings; veneer peeler cores; and a combination of two or more of these.
3. "Round wood waste" means a type of wood waste in the form of portions of trees whose diameters at breast height at the time of harvesting of the tree are less than 17 cm.
4. "Veneer waste" means a type of wood waste in the form of veneer pieces generally unsuitable for producing plywood or laminated veneer lumber.
5. "Structural wood beam" means any compressed and bonded composite wood beam, post, or plank, either of rectangular cross section such as 2×4", 2×6", 4×4", 4×6", etc., or of contoured cross section such as I, L, or U-shaped.
6. "Adhesive" means any one of isocyanate adhesives, thermosetting adhesives, cold-setting adhesives, water emulsion adhesives, phenol formaldehyde adhesive, any other adhesive used in the wood laminating industry, and combinations of any two or more of these.
7. "Wood softening temperature" means a temperature substantially at or above the glass transition temperatures (Tg) of both lignin and hemicellulose at the particular moisture content of the wood.
8. "Divided" or "dividing" as applied to the formation of wood strands means the cutting of such strands from solid wood pieces by slicing with a knife, or sawing, or using some other separating technique.
9. "Average" means the arithmetic mean of a plurality of reasonably representative quantities, i.e., the sum of such quantities divided by the number of such quantities.

Figure 2:
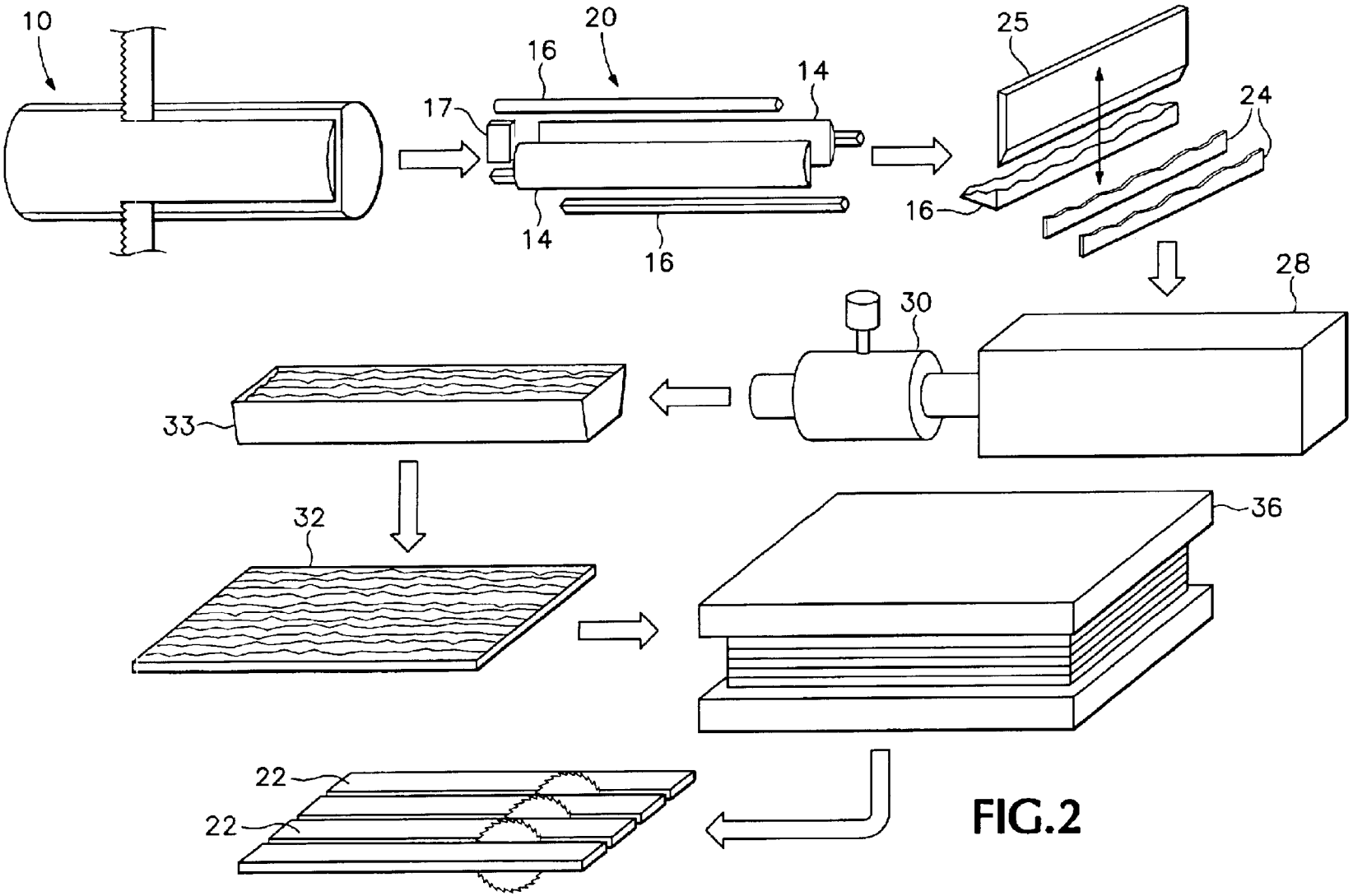
FIG. 2 shows a schematic representation of one exemplary method for forming structural wood beams in accordance with the present invention.

FIG. 2 shows an exemplary process that converts wood waste 20 from a log 10 into products 22 that are compressed structural wood beams with rectangular cross-sections. For illustrative purposes, FIG. 2 depicts wood waste 20 as comprising milled wood waste, such as 14, 16, and 17, which constitutes at least a major volume of the product 22. However, any other forms of wood waste may be suitable, including but not limited to round wood waste and veneer waste. Though FIG. 2 depicts the product 22 as commercially dimensioned boards, other compressed structural wood beams may be produced in accordance with the disclosed method, such as molded beams of contoured cross-section.

In brief summary, wood waste pieces 14, 16, and 17 are divided into strands 24 that are later compressed and adhesively bonded. Unlike existing methods for compressing wood strands into a structural wood beam, strands 24 may have highly non-uniform cross-sectional dimensions, and each strand may have a relatively large cross-section. The disclosed process may effectively form a product 22 from strands 24 of widely variable dimensions with an average width and/or thickness well beyond those allowed by the analogous existing methods that use strands formed from wood other than wood waste.

Because the disclosed method permits the product 22 to be compressed from strands 24 of large and non-uniform cross-sectional dimensions, particularly with respect to their widths, the foregoing inefficiencies of existing methods of forming lumber from wood strands may be avoided. For example, the disclosed method does not require repeated subdivisions of the strands 24. In fact, as shown in FIG. 2, it is possible to slice a usable strand 24 from a piece of wood waste such as 16 with only a single pass of a reciprocating or rotary knife 25, referred to herein as a "single knife pass," thereby forming a strand of varying width and thickness.

Figure 1A:
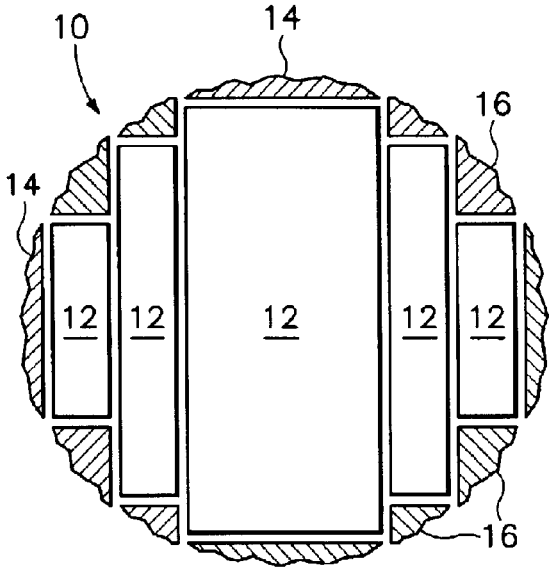
FIGS. 1A and 1B show several types of wood waste suitable for use in the present invention.
Figure 1B:
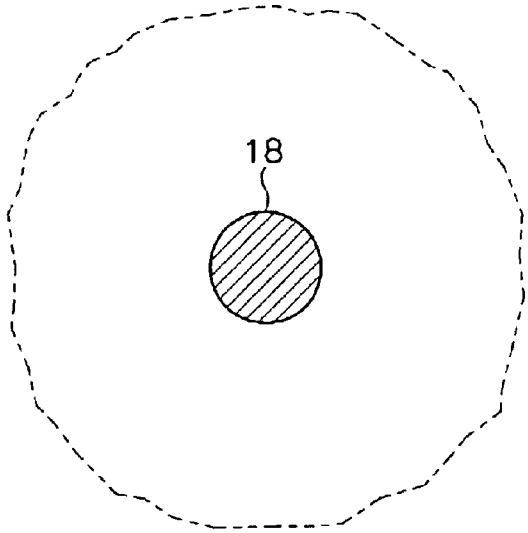
Figure 3A:
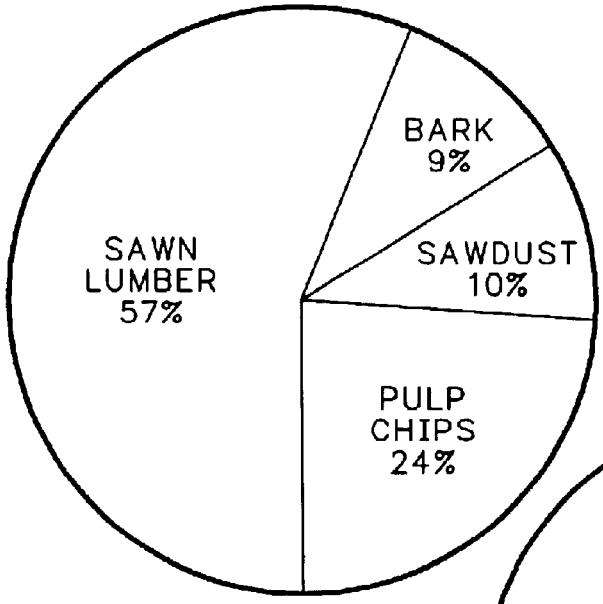
FIG.3A PRIOR ART
FIGS. 3A and 3B show a graphical representation of an exemplary improvement in wood usage achieved by the present invention (FIG. 3B) over the prior art (FIG. 3A).
Figure 3B:
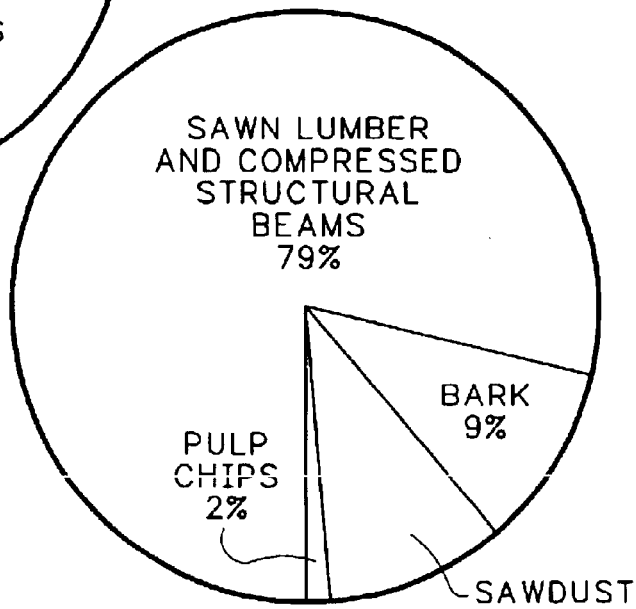

FIGS. 3A and 3B compare the approximate present distribution of wood resources in a typical sawmill (FIG. 3A) to an estimated distribution of wood resources if the disclosed method were used (FIG. 3B). This comparison illustrates the potential economic benefit of the disclosed process. Presently, only a slight majority of the available wood can be used for sawn lumber, while the remaining waste is divided between sawdust, bark, and pulp chips. Though compressed structural wood beams may also presently be produced, they are normally formed from wood that would otherwise be used for high-value sawn lumber or veneer. By contrast, the disclosed method forms compressed structural wood beams from wood waste that would otherwise be used for pulp chips. In this manner, nearly 80% of available wood resources in a sawmill may be used to produce high-value sawn lumber and compressed structural wood beams. Though the most economically beneficial process would form compressed structural wood beams from strands formed entirely from wood waste, such strands can readily be intermixed with strands formed from other wood or lignocellulose sources as desired. To attain the economic benefits of the disclosed process, however, a compressed structural wood beam should preferably be formed from strands, at least a major volume of which are derived from wood waste.

Referring again to FIG. 2, the log 10 providing source wood for the strands 24 may be of any species or variety of softwood or hardwood used to produce wood products, such as pine, fir, hemlock, larch, spruce, oak, cedar, etc., or combinations of any such species of wood. Wood waste 20 may comprise milled wood waste, i.e., the byproduct of any milling operation such as canting logs (leaving slabs), edging boards to marketable widths (leaving edgings), trimming boards to marketable lengths (leaving end trimmings), and peeling veneer to the diametric core limit of a veneer lathe (leaving peeler cores). In addition, wood waste 20 may comprise round wood waste or veneer wood waste. This enumeration of potential sources of wood waste is not exhaustive, since virtually any type of wood waste other than bark or sawdust may provide a source of strands 24 usable in the disclosed method.

Wood waste 20 is divided into strands 24 by any appropriate procedure. Where a bladed instrument is used, such as one or more knives 25, a strand 24 is preferably formed from wood waste 20 with a single knife pass (or multiple knife passes, although that is less desirable). Because the disclosed method utilizes strands 24 that do not have to conform to uniform, small cross-sectional dimensions, a wider range of procedures are available than are presently used. For example, although individual pieces of wood waste 20 might be held in place while successive strands 24 are sliced or otherwise cut generally longitudinally from them, the present process does not require such precision. Instead, it is more efficient simply to feed the pieces of wood waste 20 in bulk into a blade that slices or chops the wood waste 20 roughly lengthwise along the grain into strands 24 of widely varying cross-sectional dimensions.

From an economic viewpoint, the chosen procedure of forming strands 24 of relatively large and non-uniform cross section is preferred because such a procedure will be less expensive than one with stricter tolerances. For example, a comparatively inexact procedure in accordance with the present disclosure is able to produce strands 24 of thickness anywhere up to about 1 cm and a width anywhere up to about 12 cm. Nevertheless, this inexact procedure is still sufficiently precise to be used with the disclosed method while minimizing weakening voids in the product 22, and its economies in simplifying and expediting the strand formation process while minimizing the strand surface area that consumes adhesive are substantial. The foregoing values should not be read as a definitive range of appropriate dimensions for strands 24 used in the disclosed method, but instead simply illustrate that the disclosed method does not demand that the strands 24 be divided with much precision. Other potential procedures for dividing the strands 24 with even more relaxed tolerances may also be compatible with the disclosed method.

Of special note is the fact that the disclosed method allows the strands 24 to have widths equal to or greater than widths of many commercial lumber products, e.g., 2×4s, 4×4s, etc., that generate milled wood waste 20 having conforming widths. Thus, in instances where wood waste 20 generated from these products is divided into each strand 24 by only a single knife pass, there is no need to control strand width at all because the width of the wood waste 20 from which the strands 24 are divided is already optimally large. Accordingly, it is anticipated that products 22 formed by the disclosed method will frequently have individual strand widths prior to compression that closely correspond to the width of the wood waste from which the strand is divided. It is preferred that the average wood waste strand width prior to compression of the structural wood beam product should be at least 2.5 cm.

Strand length similarly corresponds to the length of the wood waste 20 from which the strand 24 is divided. Such lengths can be quite long, frequently reaching 250 cm. It is known that the strength of a composite structural wood beam improves as the average length of its component strands increases. At least a major volume of the strands 24 used in the disclosed method should preferably have a length-to-width ratio of at least three. This presents little restriction, given that most pieces of wood waste 20 will produce at least such a dimensional ratio in the absence of strand subdivision.

Once a sufficient volume of strands 24 have been divided from wood waste 20, the strands 24 are preferably dried in an oven 28 prior to application of an adhesive. The strands 24 may be dried to a moisture content compatible with the adhesive to be used, typically about 8–10% on an oven dry-weight basis. Then the strands 24 are mixed with an adhesive in any convenient manner, such as the drum blender 30 shown in FIG. 2, whose adhesive is sprayed onto the strands 24 while they are being tumbled. Other means of mixing adhesive with the strands 24 may readily be substituted. The requisite amount of adhesive increases proportionally with the surface area of the strands 24 to be bonded. Because the disclosed method allows strands 24 of larger cross-sectional dimensions, less adhesive is required thus reducing the cost of production of the product 22. The manner of determining an appropriate moisture content for strands 24 and an appropriate amount of adhesive to mix with the strands 24 is well known. A 3% mixture of adhesive to oven dry-weight of wood strands is often sufficient, though other ratios may be appropriate in some circumstances.

Once the adhesive is applied, the strands 24 may be distributed in a mat 32 to optimize the desired performance characteristics of the product 22. As one aspect of the distribution, the strands 24 may roughly be aligned directionally, either on the mat 32 or in a pre-alignment tray 33. The optimal directional orientation of the strands 24 will largely depend on both the type of product 22 being formed and the intended purpose of the product. With respect to strand orientation, it is useful to categorize the strands 24 into longer strands (e.g., those that have a length of at least 30 cm) and shorter strands (e.g., those having lengths less than 30 cm.) In the case of a product 22, such as a structural wood beam, it is generally desirable to ensure that the majority of the longer strands have lengths oriented more longitudinally than transversely with respect to the longitudinal axis of the beam, while a majority of the shorter stands are not so oriented but rather are distributed more randomly and intermixed with the longer strands. This distribution of strands contributes to the resistance of the beam not only with respect to bending stresses, but also with respect to shear stresses.

It also is useful to vary the ratio of intermixed longer strands to shorter strands through the cross section of the product 22. In this manner, long and directionally oriented strands may be concentrated toward the surface of the product 22, particularly along its longitudinal edges, to improve strength where high bending stress occurs, while shorter, randomly oriented strands may be concentrated in the inner region of the product to provide improved shear resistance.

As another aspect of the strand distribution, a predetermined density variation within the product 22 may be established. Provided that sufficient compressive force can be applied, the local density of the product 22 at specific points may be increased simply by adding more strands 24 at those points in the mat 32 prior to compression. For example, it has been found that an increased density at central locations within the product 22 generally tends to improve shear resistance while increased density along the longitudinal edges improves bending resistance.

Also, the compression process will frequently tend to compress the strands 24 unevenly. For example, if the mat 32 of strands 24 is heated and compressed in a press such as 36, those strands 24 adjacent to the hot die of the press 36 tend to be pressed together more densely than those strands 24 in the central region of the mat 32. This results in a harder and denser shell that improves resistance to moisture absorption for the life of the product 22.

Once the strands 24 have been arranged in a mat 32, the mat 32 may be compressed in a press 36 in a direction generally perpendicular to the grain of the longer strands and to their widths. A large-area split die may be used to compress a wide mat for later sawing into one or more products 22, or a single or multiple cavity mold may conform the product to a desired shape during compression. The press 36 may be of any appropriate type, receiving either multiple mats 32 incrementally, or receiving a continuously fed mat.

When using wood waste strands 24 of widely varying, relatively large cross sectional dimensions as in the disclosed process, it is preferable to heat the strands 24 to a point at or above the wood softening temperature of the strands 24 prior to compression. This is because it is desirable to eliminate gaps between strands to achieve the highest possible amount of surface-to-surface contact between adjacent strands and thereby maximize the bonding strength provided by the adhesive. Generally speaking, softening the wood by heating to a point at or above the wood wood softening temperature performs two related functions that enable the surface-to-surface contact between adjacent strands to be maximized without other adverse effects. First, it allows maximum deformation of the polymers of the wood under minimum pressure, increasing the contact area between surfaces of adjacent fibers because the wood will tend to "flow." Second, it reduces micro-fractures caused by flattening of the cell walls of the wood during compression, especially at points of overlap of adjacent strands. If the wood is not softened first, then the micro-fractures reduce the strength of the wood by providing originating points for larger fractures that can result from bending or shear stresses. Softening the wood also enhances conformity to the shape of the die.

Wood can be envisaged as a composite material where reinforcing fibers are embedded in a matrix of lignin, which is a polymer that essentially acts as a cementing agent in both the cell walls of wood and the areas between cells. Each of the reinforcing fibers, in turn, is a composite material where cellulosic microfibrils are embedded in a matrix of lignin and hemicellulose, which is another polymer. Approximately 50% of wood is cellulose by weight. In softwoods, lignin accounts for approximately 23–33% of wood by weight, and in hardwoods lignin accounts for approximately 16–25% of wood by weight.

When wood is heated sufficiently, its mechanical properties transition from elastic to viscous, i.e., the wood softens to a point where it is pliable and capable of deformation to a new shape without fracturing wood cells. This property, called viscoelastic behavior, is common to a number of other materials such as glass and rubber. With wood, it has been determined that the amorphous polymers such as lignin and hemicellulose give wood its viscoelastic property. The cellulose microfibrils are not viscoelastic at moisture contents less than 15%, the range to which wood is normally dried for use in compressed composite wood products.

The glass transition temperatures (Tg) of lignin and hemicellulose denote the midpoint of the glassy to rubbery transition region where there is an abrupt decrease in the stiffness. See M. P. Wolcott et al., "Fundamentals of Flakeboard Manufacture: Viscoelastic Behavior of the Wood Component," *Wood and Fiber Science Journal of the Society of Wood Science and Technology*, Vol. 22, No. 4, October 1990, page 348, which is incorporated by reference herein. Tg is highly dependent upon the moisture content of the wood, decreasing as the moisture content increases. At zero moisture content, the Tg of the hemicellulose and lignin are both approximately 200° C. but, as moisture content increases, the Tg for hemicellulose decreases more rapidly than the Tg for lignin. Both the lignin Tg and the hemicellulose Tg can be calculated using the Kwei model, which is well known in the industry. In the moisture content range for the manufacture of wood composites, Tg for the hemicellulose is 30° C. at 10% and 10° C. at 15% moisture content, while for lignin the Tg is 75° C. at 10% and 60° C. at 15% moisture content. When applying heat and pressure to form composite wood products in accordance with the disclosed method, a heating time schedule should be calculated so that the glass transition temperatures Tg of both lignin and hemicellulose at the wood's moisture content are reached or exceeded in at least most of the wood volume before maximum compression occurs. Heating the strands also speeds the curing process of the adhesive, and it is therefore desirable to control the time of heating so that wood softening and compression can occur before substantial curing occurs. Fortunately, this objective is attainable because softening, compression, and curing all proceed at relatively proportional rates in the same area of the mat, i.e., more rapidly near the outer surfaces and less rapidly in the interior regions.

Experimentation by the inventors hereof has revealed a press closing strategy that effectively heats the mat to the wood softening temperature in specific areas of the mat at a rate that just leads the rate of compression in those same areas, thereby heating the strands 24 above the wood softening temperature prior to the completion of compression in those areas as described above. In addition to the benefits which wood softening imparts to the product, this strategy also reduces the amount of pressure the press must apply to the mat by approximately ⅓ and also minimizes the total pressing time. In general, the strategy comprises heating the mat while also compressing it according to a predetermined time schedule so as to heat an outer portion or portions of the mat to the wood softening temperature before completing compression thereof, and thereafter heat an inner portion or portions of the mat to the wood softening temperature before completing compression thereof. Preferably, compression of a mat portion is completed sufficiently soon after the portion has been heated to the wood softening temperature that substantial curing of the adhesive is prevented in that portion prior to the completion of compression thereof. This strategy is exemplified in the discussion below with respect to FIGS. 4–7.

Once the mat has been compressed and the adhesive has cured, the mat may be removed from the press 36 and shaped by sawing and/or trimming to the final product dimensions. If a single or multiple cavity mold is used to shape beams of rectangular or contoured cross-sections, the amount of sawing is minimized.

Figure 4:
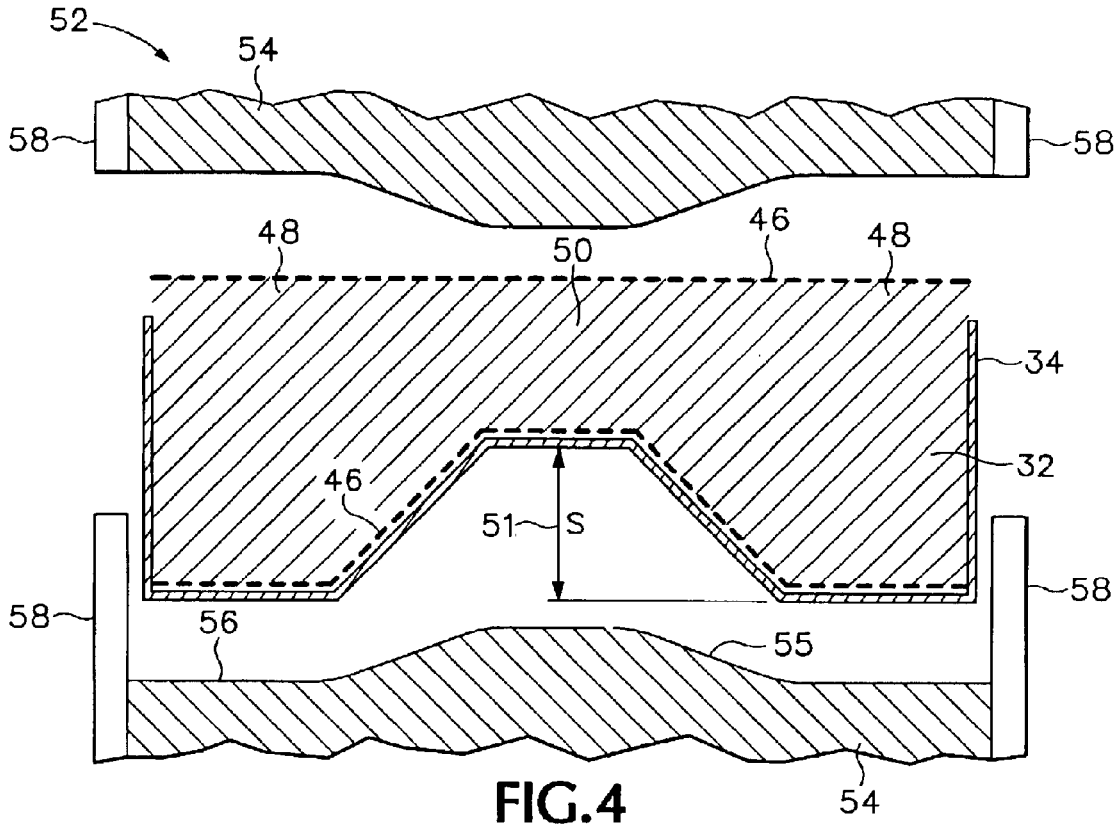
FIG. 4 shows a sectional view of a mat of wood waste material being placed in a mold for forming an exemplary I-beam in accordance with another exemplary method.
Figure 5:
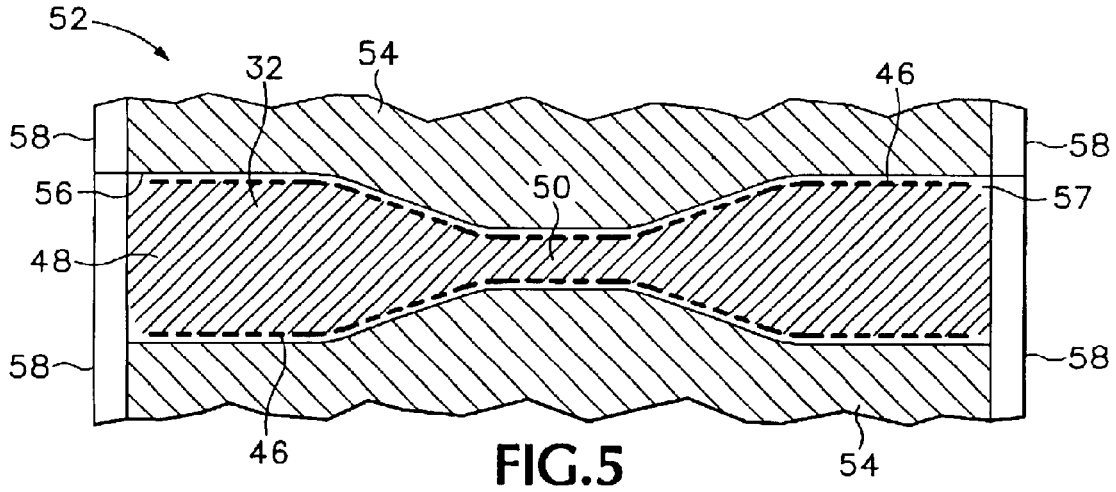
FIG. 5 shows a sectional view of the mat of wood waste material depicted in FIG. 4, immediately after compression in the mold.
Figure 6:
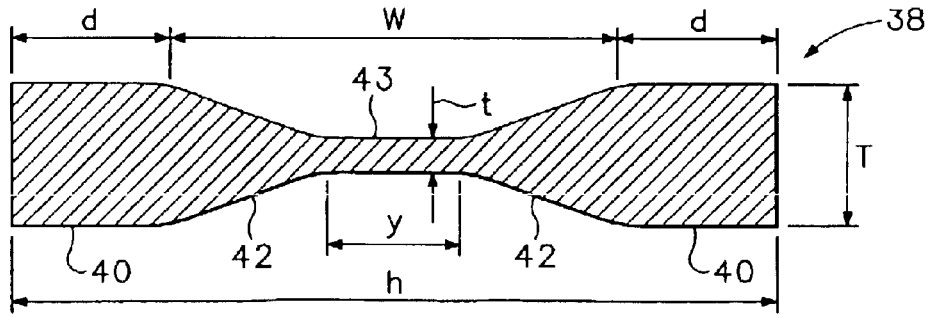
FIG. 6 shows a sectional view of the I-beam resulting from FIG. 5, after finishing thereof.
Figure 7:
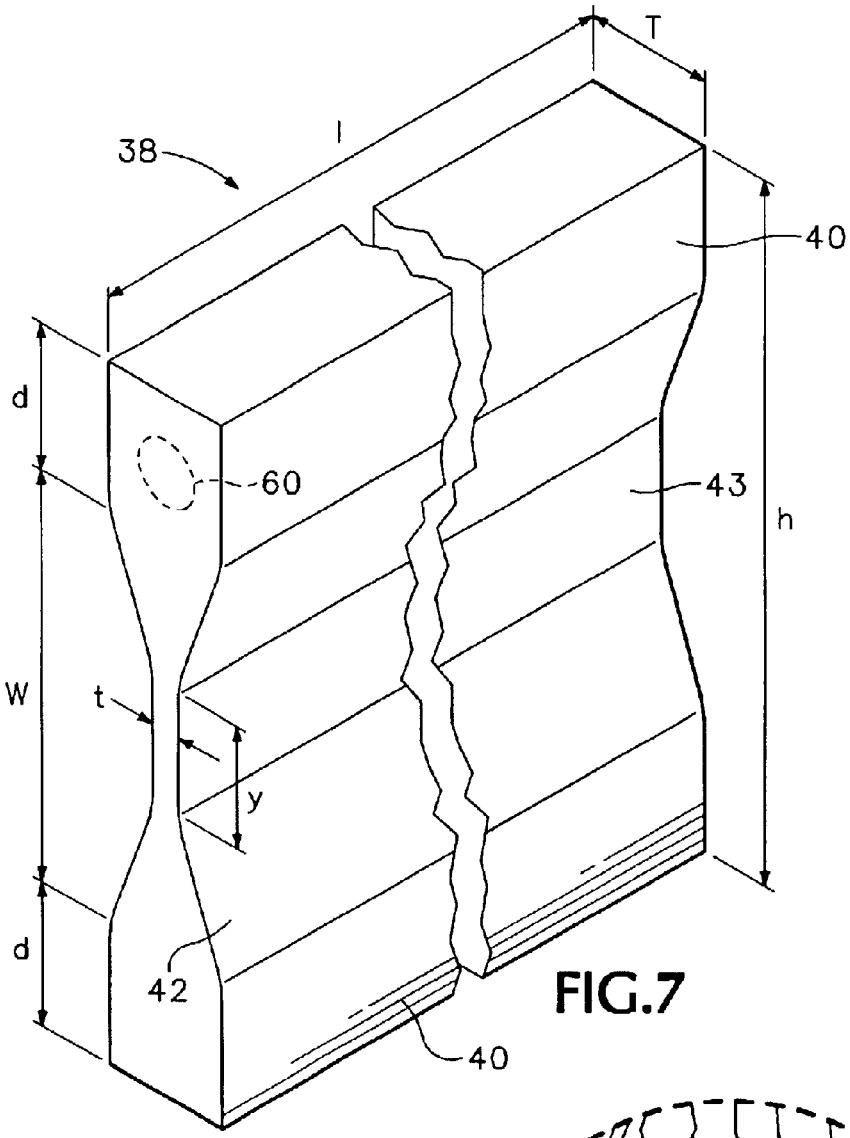
FIG. 7 shows a perspective view of the I-beam of FIG. 6.

FIGS. 4–7 illustrate an exemplary process for forming an I-beam 38 in accordance with the disclosed method. This example is illustrative only, as many shapes and sizes of beams may be formed with the disclosed method. Referring to FIGS. 6 and 7, the sample I-beam 38 is an elongate structural wood beam having a length 1 of approximately 2.44 m along a longitudinal axis and a height h of approximately 30 cm. The I-beam has two flange portions 40 having a thickness T of approximately 4.45 cm extending parallel to the longitudinal axis of the beam along opposing longitudinal edges. Each flange portion 40 has a depth d measuring approximately 4.60 cm with the flange portions connected by a web portion 42 traversing the approximate 20.8 cm width w between the flange portions 40. The web portion 42 includes a central section 43 occupying a minor portion of the web width w. The web portion 42 gradually increases in thickness from a minimum web thickness t of approximately 1.27 cm at the center of the beam 38. The density of the flange portions 40 is about 45 lb. per cubic ft with the density of the web portion 42 approximately the same value, although in many applications it would be beneficial to design the web portion 42 with a higher density than the flange portions 40 by distributing more strands in the web portion 42 prior to compression.

With respect to the type and preparation of source lumber used in the exemplary I-beam 38 shown in FIGS. 4–6, milled wood waste from Ponderosa Pine logs is sliced into strands in accordance with the disclosed method. Other forms of wood waste could be used, if desired. The wood waste is sliced with a Bamford 27" reciprocating slicer, forming each strand with a single pass of a knife blade. The strands have widely varying lengths of up to 68.6 cm with an estimated mean length of 30.48 cm. The width of each strand ranges from 0.317 cm to 5.08 cm and the thickness of each strand ranges from 0.025 cm to 0.457 cm. The average width of the strands is greater than 2.5 cm. The strands are dried to a moisture content of approximately 10%. Strands are coated with Isobind 1088 Neat, an isocyanate resin, in a drum blender that tumbles the strands while an amount of glue equal to 3% of the dried wood weight is sprayed.

Referring specifically to FIG. 4, the strands (not shown individually) are laid into a mat 32 within a forming tray 34. The bottom of the forming tray 34 is lined with a liner 46 comprising a 40 mesh 0.010 wire screen used to hold the mat 32 together when it is removed from the forming tray 34. Strands are laid up in the forming tray 34 by hand and positioned so that a major portion of the longer strands in the flange areas 48 will be oriented along the longitudinal axis of the I-beam 38. For purposes of this particular I-beam 38, strands of 30 cm or greater in length are considered longer strands. The web area 50 is given a higher content of shorter strands and a lesser volumetric percentage of longitudinally oriented strands than in the flange areas 48. The strands in the web area 50 are also distributed so as to have a somewhat higher average compressed density than the strands in the flange areas 48. A large difference in depth between the flange areas 48 and the web area 50 of the mat is maintained by forming an exaggerated step 51 in the lower surface of the forming tray 34, which is approximately three times the height of the corresponding step 55 in the mold cavity. This is done because it would be difficult to form a mat 32 with a steep slope between the flange areas 48 and the web area 50 at the upper surface, which is unsupported. Though this results in an asymmetrical mat 32, the asymmetry is eliminated during compression where the mat 32 will be forced into its intended shape.

Once the mat 32 is formed, a 40 mesh 0.010 wire screen is placed over the top of the mat 32 to form the top of the liner 46 so that the liner encloses the upper and lower surfaces of the mat 32. The forming tray 34 is then positioned in the mold cavity 57 of a split die mold 52 in a steam heated press (not shown). Once in position, the forming tray 34 is pulled from beneath the mat 32 that remains held together by the liner 46.

The split die mold 52 comprises two platens 54 with opposed and symmetrical inner surfaces 56 which, together with the screens of the liner 46, are sprayed with a release agent LPS MR-850 Lecithin so that the isocyanate resin does not stick to the platens 54. The platens 54 preferably have a length and width a little larger than the respective intended length and width of the finished I-beam 38 while the inner surfaces 56 of the mold cavity 57 conform as closely as possible to the intended shape of the outer surfaces of the I-beam 38, shown in FIG. 6. Each of the inner surfaces 56 has a pair of stops 58. As can be seen in FIG. 5, when the two platens 54 are moved together to the fully-closed point at which the stops 58 press together, the inner surfaces 56 and the stops 58 will together compress the mat 32 into approximately the desired shape and dimensions of the I-beam 38.

The steam heated press, with each of the platens 54 of the split die 52 heated to a temperature of 163° C., heats and softens the wood while closing the split die 52 under computer/servo control. The maximum hydraulic ram pressure is in the range of 2400–2800 psig for an average mat pressure in the range of 533 to 622 psi. The resultant specific weight in the flange portions of the beam is about 42–46 lb. per cubic foot, and in the web portion about 51–55 lb. per cubic foot. The cycle time is approximately 110 seconds to fully close the split die 52, 21 minutes to hold at pressure and 20 seconds to decompress and open the split die 52. The total press cycle time is approximately 23 minutes. The finished I-beam 38 is pulled from the press and the liner 46 removed. The beam is then trimmed to its final size.

To exemplify the previously-mentioned preferred press-cloning strategy that heats the strands above the wood softening temperature slightly in advance of the completion of compression, other beams are made in accordance with FIGS. 4–7. Because the mat 32 consists of a loose pile of strands, it is initially a very poor conductor of heat, but the press-closing strategy compensates for this. The first press closing step quickly closes the heated platen dies 54 to within ½ inch of the final closed position where the stops 58 meet, thus pre-compressing adjacent strands into a more intimate contact that greatly improves the rate of heat penetration. As the wood softening temperature is reached by the outer or shell strands in direct contact with the die, the resultant increasing density of the shell area of the mat also enhances the rate of heat penetration deeper into the mat. Simultaneously, mat pressure is slowly increased by continuing to close the press according to an accurately controlled predetermined time schedule toward the final fully-closed position, thus simultaneously further enhancing the compression and heat transfer rate of the softened wood. The final closed position is reached before substantial curing of the adhesive, to avoid adhesive bonds that would stiffen the mat and be broken by further compression thereby weakening the final product. The best beams are made with the following closing increments at approximately ⅓ less hydraulic ram pressure than in the previous example:

| INCHES FROM FULL CLOSURE | ELAPSED TIME |
|---|---|
| 5 (Full open) to 0.5 | 10 sec |
| .5 to .4 | 30 |
| .4 to .3 | 45 |
| .3 to .2 | 60 |
| .2 to .1 | 75 |
| .1 to full closure | 90 |

The cycle time to full closure of the split die may be increased if more wood softening, particularly in the inner regions of the mat 32, is desired prior to the completion of compression at full closure of the platens 54 to yield optimum bonding.

Figure 8:
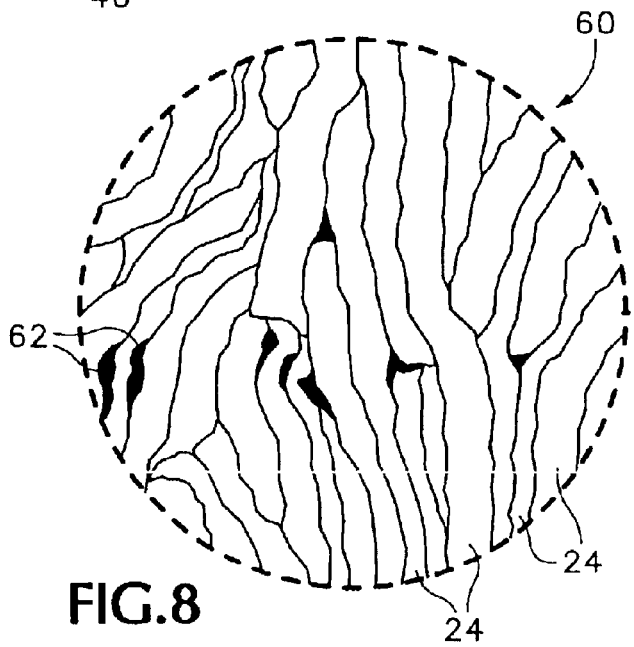
FIG. 8 is a magnified portion of the cross section of the I-beam of FIG. 7.

FIG. 7 shows a perspective view of the exemplary I-beam 38. As can be seen from the magnified portion 60 shown in FIG. 8, the disclosed method is able to closely compress the wide individual strands 24 so that they form and flow around one another with gaps 62 of minimal size and quantity, despite the fact that the strands 24 have widely varying and relatively large cross-sectional dimensions as shown in FIG. 8. Accordingly, the sample I-beam 38 has a high strength and is suitable for commercial use.

The examples just given are merely illustrations of the manner in which a product 22 could be fashioned using the disclosed method. The disclosed method is sufficiently flexible to encompass a variety of alternative procedures to fashion a variety of products 22, of which the sample I-beam 38 is simply one. In fact, design considerations based on the intended use of the product 22 will often dictate that departures be made from the procedures just described. As one example, if the strands 24 are made from wood waste 20 of a relatively weak wood, as opposed to the ponderosa pine used in the previous example, it may be beneficial to compensate by increasing the density of the product 22, necessitating a higher pressure during compression. The requisite temperature and time for compression will also vary depending upon the moisture content of the strands 24, the curing characteristics of the adhesive, heat transfer variables and so forth. Strand orientation will vary based on the intended design of the product 22. The web may or may not have a higher average compressed density than the flange portions. Many types of adhesives are interchangeable in the disclosed method, and many procedures exist to form a mat 32 other than the use of a forming tray 34. In addition, a multiple cavity split-die or other mold may be used to fashion multiple beams simultaneously.

The terms and expressions that have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims that follow.

What is claimed is:

1. An elongate structural wood beam comprising flange portions of a first average thickness extending parallel to a longitudinal axis of said beam along opposing longitudinal edges thereof, said flange portions being transversely interconnected by a central web portion of said beam having a second average thickness less than said first average thickness, at least a major volume of said wood beam being composed of compressed and adhesively bonded elongate wood strands, said web portion having a web width measured transversely from one of said flange portions to the other of said flange portions, said web portion gradually increasing in thickness, from a central section thereof occupying a minor portion of said web width, transversely toward each of said flange portions.

2. The structural wood beam of claim 1 wherein said elongate wood strands are formed from at least one of the following types of wood waste: (a) divided milled wood waste pieces, (b) divided round wood waste pieces, (c) divided veneer waste and (d) a combination of any two or more thereof.

3. The structural wood beam of claim 1 wherein said elongate wood strands have an average width of at least 2.5 cm prior to compression.

4. The structural wood beam of claim 1, a majority of longer ones of said strands having lengths oriented more longitudinally than transversely with respect to said longitudinal axis of said beam and a majority of shorter ones of said strands having lengths not so oriented, said longer ones of said strands having lengths of at least 30 cm and said shorter ones of said strands having lengths less than 30 cm.

5. The structural wood beam of claim 4 wherein said strands which are not so oriented are intermixed with said strands which are so oriented.

6. The structural wood beam of claim 5 wherein a ratio between said strands which are so oriented and said strands which are not so oriented varies over the cross section of said beam.

7. The structural wood beam of claim 1 wherein said strands include strands each formed from a piece of milled wood waste by only a single knife pass.

8. The structural wood beam of claim 1 wherein said strands include strands each formed from a piece of round wood waste by only a single knife pass.

9. The structural wood beam of claim 1, said elongate wood strands including strands at least 30 cm in length having lengths of an orientation more longitudinal than transverse with respect to said longitudinal axis of said beam, a volumetric percentage of elongate wood strands within said flange portions having said orientation and a lesser volumetric percentage of elongate wood strands within said web portion having said orientation.

10. The structural wood beam of claim 1 wherein said strands in said web portion have an average compressed density greater than that of said strands in said flange portions.

11. The structural wood beam of claim 1 wherein said strands in said web portion have an average length less than that of said strands in said flange portions.

12. An elongate structural wood beam comprising flange portions of a first average thickness extending parallel to a longitudinal axis of said beam along opposing longitudinal edges thereof, said flange portions being transversely interconnected by a central web portion of said beam having a second average thickness less than said first average thickness, at least a major volume of said wood beam being composed of compressed and adhesively bonded elongate wood strands, a majority of longer ones of said strands having lengths oriented more longitudinally than transversely with respect to said longitudinal axis of said beam and a majority of shorter ones of said strands having lengths not so oriented, said longer ones of said strands having lengths of at least 30 cm and said shorter ones of said strands having lengths less than 30 cm.

13. The structural wood beam of claim 12 wherein said elongate wood strands are formed from at least one of the following types of wood waste: (a) divided milled wood waste pieces, (b) divided round wood waste pieces, (c) divided veneer waste and (d) a combination of any two or more thereof.

14. The structural wood beam of claim 12 wherein said elongate wood strands have an average width of at least 2.5 cm prior to compression.

15. The structural wood beam of claim 12, said flange portions including a greater volumetric percentage of said longer ones of said strands than said web portion.

16. The structural wood beam of claim 15 wherein said strands which are not so oriented are intermixed with said strands which are so oriented.

17. The structural wood beam of claim 16 wherein a ratio between said strands which are so oriented and said strands which are not so oriented varies over the cross section of said beam.

18. The structural wood beam of claim 12 wherein said strands include strands each formed from a piece of milled wood waste by only a single knife pass.

19. The structural wood beam of claim 12 wherein said strands include strands each formed from a piece of round wood waste by only a single knife pass.

20. The structural wood beam of claim 12 wherein said strands in said web portion have an average compressed density greater than that of said strands in said flange portions.

21. The structural wood beam of claim 12 wherein said strands in said web portion have an average length less than that of said strands in said flange portions.

22. An elongate structural wood beam comprising flange portions of a first average thickness extending parallel to a longitudinal axis of said beam along opposing longitudinal edges thereof, said flange portions being transversely interconnected by a central web portion of said beam having a second average thickness less than said first average thickness, at least a major volume of said wood beam being composed of compressed and adhesively bonded elongate wood strands, said strands in said web portion having an average compressed density greater than that of said strands in said flange portions.

23. The structural wood beam of claim 22 wherein said elongate wood strands are formed from at least one of the following types of wood waste: (a) divided milled wood waste pieces, (b) divided round wood waste pieces, (c) divided veneer waste and (d) a combination of any two or more thereof.

24. The structural wood beam of claim 22 wherein said elongate wood strands have an average width of at least 2.5 cm prior to compression.

25. The structural wood beam of claim 22, a majority of longer ones of said strands having lengths oriented more longitudinally than transversely with respect to said longitudinal axis of said beam and a majority of shorter ones of said strands having lengths not so oriented, said longer ones of said strands having lengths of at least 30 cm and said shorter ones of said strands having lengths less than 30 cm.

26. The structural wood beam of claim 25 wherein said strands which are not so oriented are intermixed with said strands which are so oriented.

27. The structural wood beam of claim 26 wherein a ratio between said strands which are so oriented and said strands which are not so oriented varies over the cross section of said beam.

28. The structural wood beam of claim 22 wherein said strands include strands each formed from a piece of milled wood waste by only a single knife pass.

29. The structural wood beam of claim 22 wherein said strands include strands each formed from a piece of round wood waste by only a single knife pass.

30. The structural wood beam of claim 22 wherein said strands in said web portion have an average length less than that of said strands in said flange portions.

31. An elongate structural wood beam comprising flange portions of a first average thickness extending parallel to a longitudinal axis of said beam along opposing longitudinal edges thereof, said flange portions being transversely interconnected by a central web portion of said beam having a second average thickness less than said first average thickness, at least a major volume of said wood beam being composed of compressed and adhesively bonded elongate wood strands, said strands in said web portion having an average length less than that of said strands in said flange portions.

32. The structural wood beam of claim 31 wherein said elongate wood strands are formed from at least one of the following types of wood waste: (a) divided milled wood waste pieces, (b) divided round wood waste pieces, (c) divided veneer waste and (d) a combination of any two or more thereof.

33. The structural wood beam of claim 31 wherein said elongate wood strands have an average width of at least 2.5 cm prior to compression.

34. The structural wood beam of claim 31, a majority of longer ones of said strands having lengths oriented more longitudinally than transversely with respect to said longitudinal axis of said beam and a majority of shorter ones of said strands having lengths not so oriented, said longer ones of said strands having lengths of at least 30 cm and said shorter ones of said strands having lengths less than 30 cm.

35. The structural wood beam of claim 34 wherein said strands which are not so oriented are intermixed with said strands which are so oriented.

36. The structural wood beam of claim 35 wherein a ratio between said strands which are so oriented and said strands which are not so oriented varies over the cross section of said beam.

37. The structural wood beam of claim 31 wherein said strands include strands each formed from a piece of milled wood waste by only a single knife pass.

38. The structural wood beam of claim 31 wherein said strands include strands each formed from a piece of round wood waste by only a single knife pass.

* * * * *